United States Patent [19]

Claydon et al.

[11] Patent Number: 4,806,844

[45] Date of Patent: Feb. 21, 1989

[54] CIRCUIT FOR PROVIDING ON-CHIP DC POWER SUPPLY IN AN INTEGRATED CIRCUIT

[75] Inventors: Glenn S. Claydon, Wynantskill; Robert P. Alley, Clifton Park; William J. Laughton, Syracuse, all of N.Y.

[73] Assignee: General Electric Company, Schenectady, N.Y.

[21] Appl. No.: 207,844

[22] Filed: Jun. 17, 1988

[51] Int. Cl.[4] ..... G05F 3/08

[52] U.S. Cl. ..... 323/311; 323/267; 323/303; 363/89; 363/147

[58] Field of Search ..... 323/267, 273, 274, 279, 323/303, 311; 363/89, 147; 307/296 R, 297, 540, 557, 561, 566

[56] References Cited

U.S. PATENT DOCUMENTS

| | | | |
|---|---|---|---|
| 3,022,457 | 2/1962 | Doan | 323/311 |
| 3,881,150 | 4/1975 | Gay | 323/311 |
| 4,290,004 | 9/1981 | Smith | 323/311 |
| 4,322,674 | 3/1982 | Kanno | 323/267 |
| 4,608,529 | 8/1986 | Mallinson | 323/303 |
| 4,712,171 | 12/1987 | Yamashita | 323/303 |

*Primary Examiner*—Peter S. Wong

*Attorney, Agent, or Firm*—Geoffrey H. Krauss; James C. Davis, Jr.; Marvin Snyder

[57] ABSTRACT

An on-chip DC power supply uses at least one series pass element which conducts responsive to a gating signal obtained by clamping an input potential to a preselected polarity and amplitude. A charge storage element serves to maintain an output voltage which is clamped to a predetermined maximum value. An output regulator provides a substantially constant second output voltage at a magnitude less than the output voltage set by the output clamping means.

9 Claims, 1 Drawing Sheet

CIRCUIT FOR PROVIDING ON-CHIP DC POWER SUPPLY IN AN INTEGRATED CIRCUIT

BACKGROUND OF THE INVENTION

The present invention relates to integrated semiconductor circuits (ICs) and, more particularly, to a novel power supply circuit which is located on the IC chip itself for providing to the chip's circuitry at least one DC operating potential, when driven either by an AC line source or a source of DC voltage, the selected source having a potential magnitude higher than the highest DC potential to be supplied by the circuit.

It is often necessary, in a semiconductor integrated circuit, to provide a relatively low voltage DC supply with minimized parts, cost and very low standby power dissipation, regardless of whether high-voltage DC or AC potential is available as the input source. It is highly desirable to provide an on-chip DC power supply and thus eliminate necessity for providing a separate DC power supply external to the integrated circuit, which external power supply would be required, in the absence of an on-chip power supply, to provide operating potential for at least a lower-voltage portion of an IC. It is also highly desirable to provide an on-chip power supply which is flexible enough to operate over a relatively wide range of input supply voltage.

BRIEF SUMMARY OF THE INVENTION

In accordance with the invention, an on-chip DC power supply comprises: at least one series pass element which conducts responsive to a gating signal; means for clamping an input potential to obtain said gating signal with a preselected polarity and amplitude; means for storing charge from a source whenever the gating signal is present, to maintain an output voltage; and means for clamping the output voltage to a predetermined maximum value.

In a presently preferred embodiment, an output regulator provides a substantially constant second output voltage at a magnitude less than the output voltage set by the output clamping means.

Accordingly, it is an object of the present invention to provide a novel DC power supply integratable on a semiconductor circuit chip, along with the integrated circuitry to be powered by the supply.

This and other objects of the present invention will become apparent upon reading of the following detailed description, when considered in conjunction with the associated drawings.

DETAILED DESCRIPTION OF THE INVENTION

Figure 1:
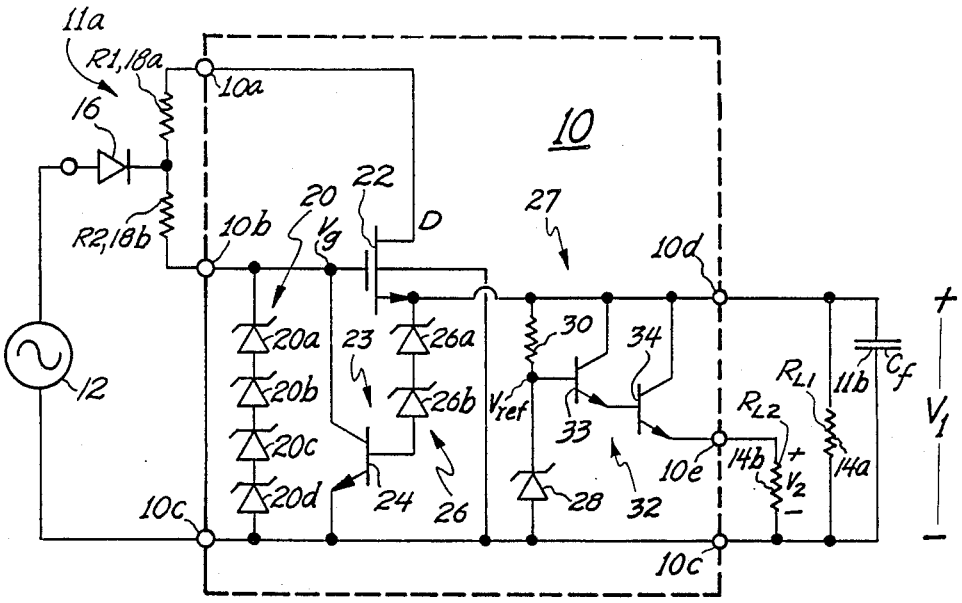
FIG. 1 is a schematic diagram of one presently preferred embodiment of an on-chip DC power supply, in accordance with the principles of the present invention.

Referring initially to FIG. 1, a presently preferred embodiment of a power supply 10 for integration within a semiconductor circuit chip and the like, is utilized with a minimum number of external, off-chip components 11, for providing at least one output voltage V from a voltage source 12, either of AC or DC type and with a peak amplitude greater than the amplitude of the highest voltage V provided across at least one associated output load 14. As illustrated, on-chip DC power supply circuit 10 provides first and second output voltages $V_1$ and $V_2$, respectively, across respective ones of a first load resistance 14*a*, of magnitude $R_{L1}$, and a second load resistance 14*b*, of magnitude $R_{L2}$. A first portion 11*a* of the off-chip components may include a unidirectionally-conducting element 16, such as a semiconductor rectifier and the like (which may not be required if source 12 provides a DC potential of desired polarity), and first and second voltage-dropping resistors 18*a* and 18*b*, respectively connected from diode 16 to one of on-chip power supply circuit terminals 10*a* and 10*b*, and respectively of magnitude $R_1$ and $R_2$. A remaining terminal of external source 12, not connected to diode 16, is connected to a power supply circuit common terminal 10*c*. The larger of the two output voltages, e.g. voltage $V_1$, can, if desired, be filtered by an off-chip capacitor 11*b*, of magnitude $C_f$; if a lower output voltage $V_2$ is derived from the highest output voltage, it may not be necessary to provide a separate output-smoothing capacitive element across any of the lower-output-voltage loads.

The on-chip power supply circuit 10 includes a first clamping circuit 20 having a means, operating with associated resistor 18, for setting a maximum gating potential $V_g$. Here, means 20 uses a multiplicity of zener diodes, e.g. four diodes 20*a*–20*d*, connected between input terminal 10*b* and common terminal 10*c*. Terminal 10*b* is connected to the control electrode of a series-pass means 22, e.g. the gate electrode of at least one N-type MOSFET device having its drain electrode connected to terminal 10*a*, its substrate connected to common terminals 10*c* and its source electrode connected to highest-output-voltage terminal 10*d*. A plurality of NMOS devices 22 may be paralleled if necessary to meet output current requirements. The magnitude of the highest output voltage $V_1$ is set by a second clamp circuit 23, which provides an output control signal to cause removal of the series-pass element conduction whenever the output voltage has reached a predetermined magnitude. The second clamp means uses a switching transistor 24 and a voltage reference 26. The transistor 24 is fabricated with its collector electrode connected to terminal 10*b*, its emitter electrode connected to terminal 10*c* and its gate electrode connected through a voltage reference 26 to terminal 10*d*; here, voltage reference 26 comprises a plurality, e.g. two, of series-connected zener diodes 26*a* and 26*b*. Here, the output control signal is the base current to transistor 24, which current increases when $V_1$ is slightly greater than the zener voltage, of devices 26*a* and 26*b*, to remove gate drive from FET 22 and stop its conduction.

Each of the output voltages of magnitude lower than the highest output voltage $V_1$ is provided by a regulator circuit 27, comprising (1) a voltage reference element 28, illustratively a zener diode, in series with a resistance element 30, between highest-output voltage terminal 10*d* and common terminal 10*c*, and (2) a series-pass regulator circuit 32, here comprised-of Darlington-connected transistors 33 and 34, having the regulator input (the collectors of both devices 33 and 34) connected to terminal 10*d* and with the regulator output (the emitter electrode of second transistor 34) connected to lower voltage output 10*e*; the regulator input element (the base electrode of first transistor 33) receives the reference voltage across reference device 28. The reference device 28 is selected for a reference voltage $V_{ref}$ substantially equal to the sum of the series-connected base-emitter voltage drop of devices 33 and 34 plus the desired output voltage, e.g. $V_{ref}=V_2+V_{be34}+V_{be33}$. Thus, if voltage $V_2$ is to be 5.0 volts for powering TTL and the like on-chip logic, and if each of devices 33 and 34 are silicon transistors with a $V_{be}$ of about 0.6 volts, then the zener diode 28 reference voltage $V_{ref}$ is about 6.2 volts.

The highest voltage $V_1$ is substantially set by the clamping voltage of zener diode stack 26. Thus, for a circuit 10 in which all of diodes 20 and 26 are of approximately 6.5 volts, voltage $V_1=2(6.5)+V_{be24}=13.6$ volts maximum at terminal 10*d*. In order to properly bias the high voltage NMOS FET device 22 gate so that the clamp voltage at terminal 10*d* is present, the MOS body effect must be taken into account; this can yield a substantial change in the turn-on threshold voltage of device 22, since the source and substrate thereof are connected to different potentials. For voltage $V_1$ between about 12 and 14 volts above the common potential at terminal 10*c*, the MOS body effect increases device 22 threshold voltage $V_{gs}$ by about 8 volts. Since the normal gate-source voltage $V_{gs}$ is about 2 volts, the body effect increases this voltage to about 10 volts so that the instantaneous output voltage $V_1$ value is the instantaneous value of the gate voltage, at terminal 10*b*, less the device gate-source voltage $V_{gs}$. Thus, for output voltage $V_1$ to be a minimum of 12 volts, the gate voltage at terminal 10*b* must be at least 22 volts. By utilizing a gate clamp 20 with 4 zener diodes 20*a*–20*d*, each of about 6.5 volts, the maximum gate voltage at terminal 10*d* is clamped at about 26 volts, which exceeds the 22 volt minimum and allows sufficient gate voltage to overcome the body effect and properly drive the at least one NMOS devices 22, while at the same time protecting the gate electrodes thereof from over-voltage breakdown.

During operation with a relatively high voltage AC source 12 connected through a diode 16 and resistors 18*a* and 18*b* to the on-chip circuit terminals 10*a* and 10*b*, the high voltage NMOS device 22 conducts during at least a portion of each positive half cycle and provides charge to the energy storage capacitor 11*b*; a DC voltage of magnitude $V_1$ is provided at terminal 10*d*. During the negative portion of each cycle of source 12, DC output potential is provided at terminal 10*d* by the energy storage capacitor 11*b*. This action repeats for each subsequent AC source cycle. As previously mentioned, zener diodes 20 serve to protect the gate of the at least one high voltage FET devices 22 from overvoltage breakdown, by clamping the gate electrode voltage to a predetermined maximum value. The NPN transistor 24 is turned on when the voltage at terminal 10*d* is sufficiently positive, which voltage is reached only when energy storage capacitor 11*b* is charged to a sufficiently high voltage during the positive source half-cycle, and the conducting device 24 serves to turn off device(s) 22 and reduce the strain on device(s) 22. It is often required that any DC power supply, whether on-chip or off, achieve a stable operating potential by the end of the first positive source half-cycle, upon initial power-up, so that errors are not experienced within the logic section or control section of the integrated circuit being powered. This dictates that the physical size and characteristics of the semiconductor devices must be chosen accordingly.

Figure 2:
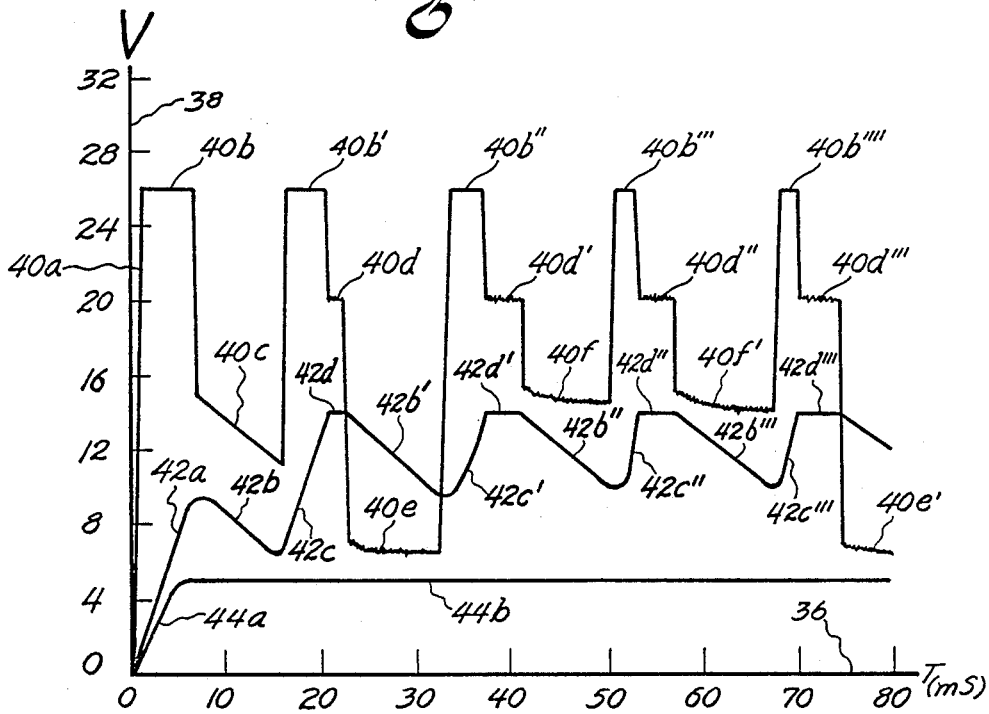
FIG. 2 is a set of time-related waveforms found within the circuit embodiment of FIG. 1, and useful in appreciating points concerning the operation thereof.

Referring now to FIGS. 1 and 2, where in the latter figure the abscissa 36 is scaled in units of time, while the ordinate 38 is scaled in units of voltage, in operation with an AC source 12, a gate voltage waveform 40 is obtained at terminal 10*b*, while a first output voltage $V_1$ waveform 42 is obtained at terminal 10*d* and a second output voltage waveform 44 is obtained at terminal 10*e*. Upon initial application of power, the source high voltage, e.g. 120 volts (RMS), causes the gate voltage to rapidly increase at terminal 10*b*, as seen in leading edge portion 40*a*, until that voltage is clamped by gate clamp means 20; in the illustrated embodiment, that clamping voltage is about 26 volts, as shown by the clamped maximum voltage portions 40*b*, 40*b*', . . . , 40*b*'''', and so on. During the increasing-voltage portion of the first positive source half-cycle, devices 22 are turned on and output voltage $V_1$, at terminal 10*d*, increases, as in portion 42*a*, to a maximum which is typically less than the maximum that the voltage $V_1$ will ever attain, but which is greater than the highly-regulated lower voltage $V_2$. Therefore, the regulated voltage $V_2$ rapidly increases, in portion 44*a*, and reaches its substantially-constant value, in portion 44*b*, well before the middle of the first positive source half-cycle, i.e. within the first quarter-cycle of the source 12 signal. As the source voltage begins to decline, in the latter half of the source positive half-cycle, the voltage across the energy storage capacitance remains fairly constant until shortly before the negative half-cycle commences. During the negative half-cycle, the storage capacitor 11*b* provides energy to all loads; the storage element voltage $V_1$ therefore falls, as shown in portion 42*b*, due to a decrease in gate voltage, in portion 40*c*. Because of circuit capacitances, the gate voltage doe not fall to zero, but remains positive, with a value greater than $V_1$, which is itself greater than $V_2$.

In the positive-polarity portion of the next source waveform, the gate voltage again rapidly increases to the clamped value (portion 40*b*') while the highest output voltage $V_2$ increases, in portion 42*c*, until the second clamp means 23 value (e.g. about 13.6 volts) is reached and held (portion 42*d*); an associated held portion 40*d* occurs in the gate voltage, prior to a "bottoming-out" portion 40*e*, when device 22 is completely off during the negative-polarity half-cycle of the source waveform. This cyclic operation of device 22, with turn-on to clamped voltage (in portion 40*b*), hold during highest output clamped peak voltage (in portions 40*d*/42*d*) and discharge (in portions 42*b*/40*c*-*e*-*f*) continues as long as the AC source is connected to circuit 10. It will be seen that use of a high-voltage DC source results in non-cyclic operation, where the output voltage(s) V rapidly increase to their selected operating values after source connection.

While several presently preferred embodiments of our novel invention have been described in detail herein, it will now be apparent that many modifications and variations can be made by those skilled in the art. For example, the rectifier diode 16 and at least one of resistors 18 could, if desired, be integrated upon the semiconductor chip. It is our desire, therefore, to be limited only by the scope of the appending claims and not by the specific details and instrumentalities presented by way of explanation herein.

What we claim is:

1. In a semiconductor circuit chip having circuitry requiring at least one DC operating potential, a power supply integratable upon said chip and, in conjunction with an external charge-storage element, acting upon the potential of an external source to provide the at least one required operating potential, comprising:

a series-pass element having a control input and a controlled circuit enabled for conduction responsive to a gating signal at said control input and cooperating with the external charge-storage element to maintain an output voltage;

first means for clamping a sample of the source potential to obtain said gating signal with a preselected polarity and maximum amplitude; and second means for clamping said output voltage to a predetermined maximum amplitude not less than a largest one of the at least one required operating potential.

2. The power supply of claim 1, wherein said first means includes at least one semiconductor device setting said maximum amplitude.

3. The power supply of claim 2, wherein each of the at least one semiconductor device is a zener diode.

4. The power supply of claim 2, wherein said second means includes an active semiconductor device having a control electrode and a controlled-conduction circuit connected to remove said series-pass element from conduction responsive to the presence of an output control signal at said control electrode; and means for providing the output control signal whenever said output voltage reaches said predetermined maximum amplitude.

5. The power supply of claim 4, wherein the active semiconductor device is a transistor having its collector-emitter circuit in parallel with said at least one device of said first means; and said output control signal providing means includes at least one zener diode coupled between output voltage and the base electrode of said transistor.

6. The power supply of claim 1, wherein said series-pass element comprises at least one field-effect transistor (FET).

7. The power supply of claim 6, wherein said FET is a NMOS FET.

8. The power supply of claim 6, wherein said series-pass element comprises a plurality of similar FETs, connected in parallel with one another.

9. The power supply of claim 1, further comprising regulator means for providing another output voltage of amplitude less than said output voltage.

* * * * *